United States Patent [19]

Freeman et al.

[11] Patent Number: 4,523,541

[45] Date of Patent: Jun. 18, 1985

[54] APPARATUS FOR APPLYING THERMOPLASTIC ADHESIVE TO FLEXIBLE DIE-CUT PARTS

[75] Inventors: D. Bruce Freeman; Bernard G. Kesse, both of Cincinnati, Ohio; Philip P. Thiel, Ft. Mitchell, Ky.

[73] Assignee: The Louis G. Freeman Company, Erlanger, Ky.

[21] Appl. No.: 614,745

[22] Filed: Jul. 23, 1984

Related U.S. Application Data

[62] Division of Ser. No. 464,156, Feb. 7, 1983, Pat. No. 4,468,418.

[51] Int. Cl.[3] ..... B05C 1/00

[52] U.S. Cl. ..... 118/202; 118/212; 118/245; 118/249

[58] Field of Search ..... 118/202, 245, 249, 212

*Primary Examiner*—Bernard D. Pianalto

*Attorney, Agent, or Firm*—Frost & Jacobs

[57] ABSTRACT

An apparatus and process for applying thermoplastic adhesive in a dot pattern to flexible die-cut parts, such as shoe parts. The apparatus includes a tank with a removable bottom and heating elements within the removable bottom of the tank, a mixing roll, an applicator roll having a pattern of indentations over the entire surface, a primary wiper, a secondary wiper, a pressure roll and a number of stripping fingers which ride in grooves in the applicator roll. The process for applying the adhesive involves rotating the mixing roll in a quantity of molten thermoplastic adhesive, transferring the adhesive from the surface of the mixing roll to the surface of the applicator roll, filling the indentations of the applicator roll with the adhesive, wiping the excess adhesive from the outer surface and grooves of the applicator roll, passing a die-cut part between the applicator roll and pressure roll whereby the adhesive in the indentations of the applicator roll is transferred to the part and guiding the part away from the applicator roll by the stripping fingers.

15 Claims, 8 Drawing Figures

APPARATUS FOR APPLYING THERMOPLASTIC ADHESIVE TO FLEXIBLE DIE-CUT PARTS

This is a division of application Ser. No. 06/464,156 filed Feb. 7, 1983, U.S. Pat. No. 4,468,418.

BACKGROUND OF THE INVENTION

1. Field of the Invention

The present invention relates generally to an apparatus and process for applying thermoplastic adhesive and, more particularly, to an apparatus and process for applying the adhesive in a dot pattern to individual, flexible, die-cut parts.

2. Description of the Prior Art

Machines which apply thermoplastic adhesive to a moving web of material have been known in the art for many years. Typically, the basic process which such machines use in operation is to rotate an applicator roll within a tank of the melted thermoplastic adhesive. The adhesive picked up by the applicator roll is transferred to the moving web of material which is held against the applicator roll by a pressure roll. As a general rule, such machines also incorporate some type of wiper or doctor blade to remove excess adhesive and control the amount of adhesive on the applicator roll which is transferred to the web.

Over the years various problems have become apparent with respect to prior art devices. Specifically, controlling the amount of adhesive is often difficult. Significant hydraulic pressures are developed by the motion of the applicator roll and the resulting shear forces created when the adhesive on its surface is impeded by the doctor blade. This pressure build up can cause the wiper to be largely ineffective resulting in too much or uneven amounts of adhesive to be passed to the web. In addition, as adhesive passes under the wiper, minute quantities tend to stick to the top of the wiper edge. After a period of time, the adhesive accumulates to form droplets which may transfer back to the applicator roll and then onto the pressure roll, causing an excessive amount of adhesive to be applied in certain spots on the web and resulting in generally unsatisfactory performance.

Heating of the thermoplastic adhesive has also been a problem in the prior art. Prior to being melted, the adhesive is hard and is in the form of relatively large pieces, pellets, or powder. Obviously, it is undesirable for the particles of unmelted adhesive to come in contact with the applicator roll and interfere with the operation of the machine. Accordingly, prior art devices have generally provided for some type of arrangement for pre-melting the adhesive. This was often done by providing a separate tank in which the adhesive was melted, and providing a conduit to supply the melted adhesive to the tank containing the applicator roll. Other arrangements have been provided where the premelt portion of the structure is adjacent the actual holding tank for the melted adhesive. However, the arrangements of the prior art tend to be rather elaborate, resulting in additional expense associated with the construction of the adhesive applying machine. Furthermore, prior art devices have not made provision to isolate the heating elements from the body of the tank. This results in excessive heat transfer to the machine elements and frame, which causes carbonization of adhesive and greater energy use. Finally, the machines have been generally directed to the application of a single type of thermoplastic adhesive and have not been constructed in such a manner which allows easy cleaning of the machine and changeover to application of another type of adhesive.

As noted previously, machines of the prior art have generally been used to apply thermoplastic adhesive to a moving web. However, in recent years a need has developed for machinery which will apply the thermoplastic adhesive to individual, flexible, die-cut parts, such as shoe parts. Although there have been some attempts to adapt the known types of adhesive applying machines to this type of use, such efforts have not been successful. Die-cut parts vary in size, shape, thickness, material, etc. A machine designed to apply adhesive to a uniform web is simply not suited to apply adhesive to die-cut parts. There must be the capability for the machine to adjust to the variables introduced by die-cut parts. In addition, it is necessary for the parts of a shoe, for example, to remain flexible after the adhesive is applied. The application of a uniform coating of thermoplastic adhesive as known in the prior art greatly reduces the flexibility of the part to which it is applied.

The more recent prior art teaches that a process whereby the thermoplastic adhesive is applied in a selected pattern solves some of the problems associated with application of thermoplastic adhesive to die-cut parts. Specifically, the pattern application allows the part to remain flexible since the adhesive is in discrete quantities rather than a uniform layer. In addition, less adhesive is used in a given area, while retaining sufficient application to obtain the necessary strength for the adhesive bond. Use of less adhesive also means less heat transferred to smaller parts which enables the parts to be handled immediately after the application of the adhesive.

There is also a tendency of die-cut parts to stick to the applicator roll when the adhesive is being transferred to the material. Accordingly, the prior art shows the provision of pick-off fingers to guide the part away from the applicator roll. In such instances, the applicator roll is generally provided with grooves in which the pick-off fingers ride, to allow for an effective means of contacting and guiding the part away. This has resulted in a secondary problem wherein adhesive accumulates in the grooves of the applicator roll and is transferred to the pick-off fingers, requiring additional wiping means for the grooves in the applicator roll.

Accordingly, the teachings of the prior art do not provide solutions to the problems related to build-up of hydraulic pressures at the wiper, transfer of droplets of adhesive from the wiper to the applicator roll to the pressure roll, excessive heat transfer to the main frame, cleaning/changing adhesive, adjustments for die-cut parts and accumulation of adhesive on pick-up fingers; all of which are solved by the present invention.

SUMMARY OF THE INVENTION

The present invention provides a unique apparatus and process for the application of a dot pattern of thermoplastic adhesive to flexible die-cut parts. The apparatus comprises a tank with heating elements in a removable bottom and a baffle to define a pre-melt zone; a mixing roll which rotates within the tank; an applicator roll; primary and secondary wipers; and a pressure roll. The applicator roll is provided with a uniform pattern of indentations which serve to hold a discrete quantity of adhesive and a series of grooves to facilitate use of pick-off fingers in the apparatus. The distance between the pressure roll and applicator roll is adjustable to allow for varying part thickness.

The process by which the apparatus operates is to rotate the mixing roll within the tank, picking up a quantity of adhesive. The applicator roll, rotating in the same direction as the mixing roll, in like manner picks up a quantity of adhesive from the surface of the mixing roll. The adhesive fills the indentations in the applicator roll and the excess adhesive is wiped off by the primary wiper. The secondary wiper spreads out any droplets of adhesive that might build up on the top of the primary wiper so that these droplets will not contact the pressure roll. Since the pressure roll rotates in the opposite direction of the applicator roll, a part placed in contact with these rolls is driven between them and picks up the adhesive contained in the indentations on the applicator roll, which appears as individual dots of adhesive on the part. The pick-off fingers guide the part away from the applicator roll.

The primary wiper, as contemplated by the present invention, pivots to vary the wiping action on the applicator roll and provides a very even pressure across the surface of the roll. In addition, the primary wiper has sufficient mass to off-set hydraulic pressures built up by the force of the adhesive between the applicator roll and the wiper itself. The primary wiper also has a series of fins which match up to the grooves in the applicator roll and function to remove excess adhesive in the grooves. This reduces an accumulation of adhesive on the stripping fingers. The fins on the primary wiper are the same diameter and radius as the wiper itself so that rotational adjustment of the primary wiper does not change the wiping action in the grooves of the applicator roll.

The location of the heating elements in the removable bottom of the tank allows the use of an insulating gasket material to greatly reduce the transfer of heat from the removable bottom to the main frame casting of the machine. Thus, heat is transferred primarily through the adhesive, keeping the machine frame cooler and decreasing heat-up time significantly. In addition, since the bottom is removable, the machine can be easily cleaned which facilitates changing the type of adhesive used. However, the primary significance of the removable bottom is the reduction of heat transfer to the areas of the machine where excessive heat is undesirable.

DESCRIPTION OF THE PREFERRED EMBODIMENTS

Figure 1:
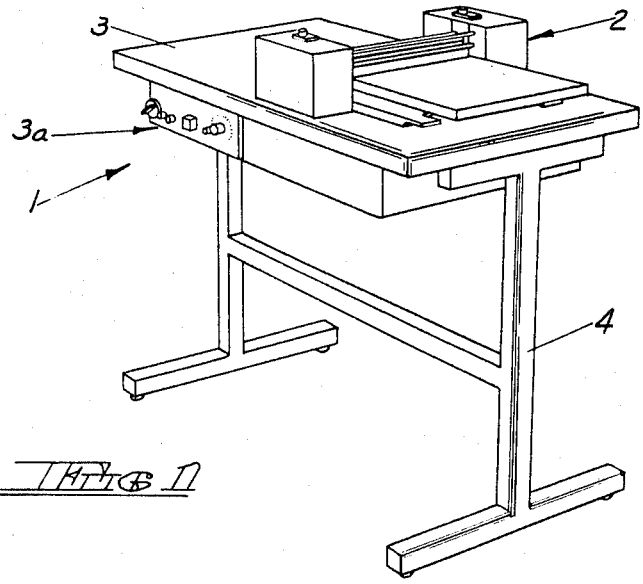
FIG. 1 is a perspective view of an apparatus for applying thermoplastic adhesive to flexible, die-cut parts in accordance with the present invention.
Figure 2:
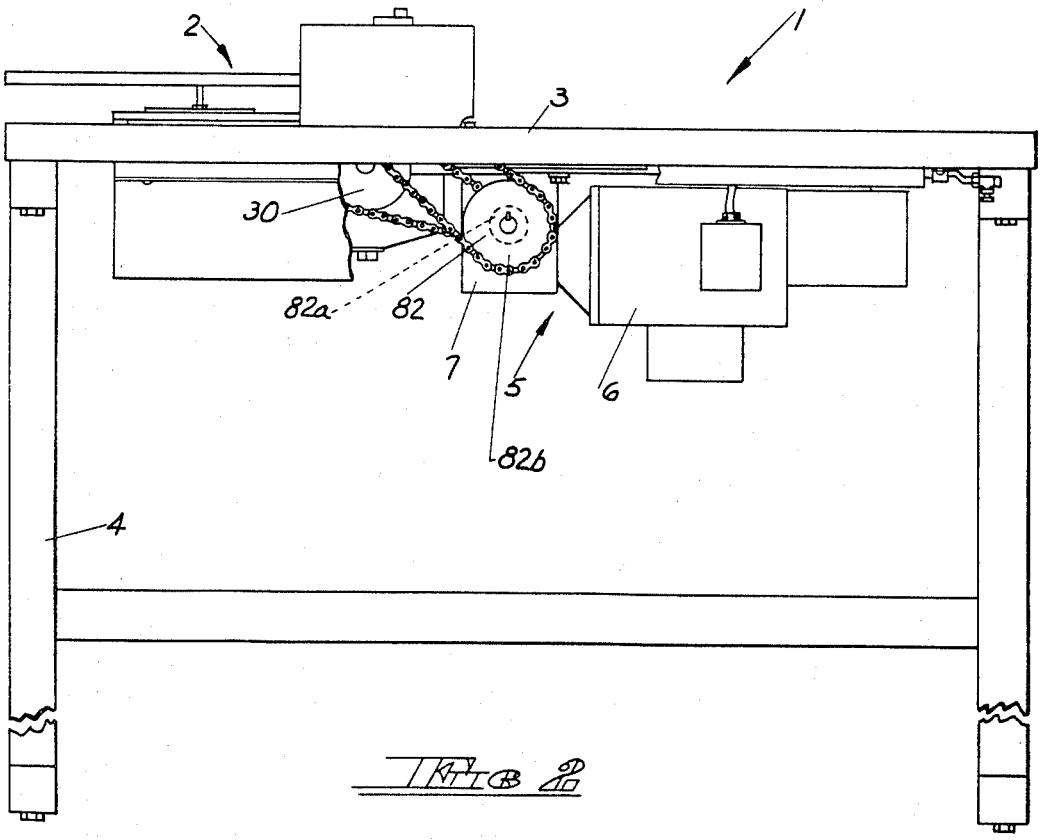
FIG. 2 is a rear elevational view of the apparatus shown in FIG. 1.
Figure 3:
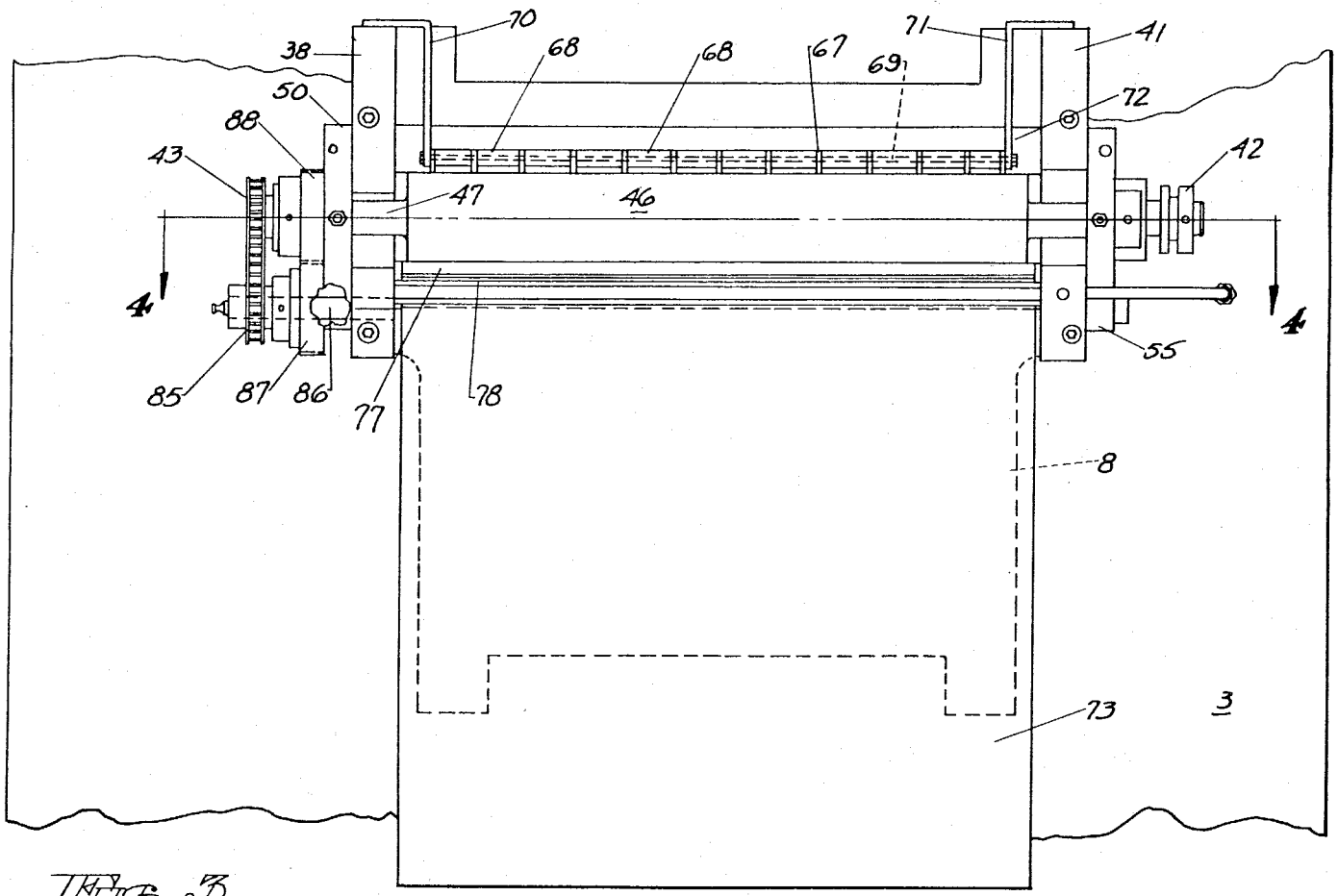
FIG. 3 is a fragmentary top view illustrating the primary functional elements of the apparatus for applying thermoplastic adhesive in accordance with the present invention.

Shown in FIGS. 1 and 2, indicated generally at 1, is an apparatus in accordance with the present invention for applying thermoplastic adhesive to flexible, die-cut parts. The primary functional elements for applying the adhesive, indicated generally at 2, are preferrably mounted in a table top 3 which is supported by appropriate framework 4. An electrical control panel 3*a* is provided at the front of the table top 3. The drive means, indicated generally at 5, which includes a drive motor 6 and a gear reducer 7, is located beneath the table top 3. The interaction of the drive means 5 with the other machine components will be more fully discussed hereinafter.

Referring now to FIGS. 3–8, a discussion of the primary elements 2 of the apparatus 1 is begun by describing the basic structural element, tank 8. This element is referred to as a tank since it acts as a reservoir for the molten adhesive to be applied, as will be more fully discussed hereinafter; however, it should be understood that the tank 8 is in actuality a main frame casting and supporting element of the primary elements 2. The tank 8 has a removable bottom 9 which is attached to the tank 8 by conventional means such as bolts, two of which are shown at 10. The tank 8 may be considered as having a main reservoir area, indicated generally at 11 which contains the molten thermoplastic adhesive during operation and a premelt area 12 where the unmelted or partially melted chunks of thermoplastic adhesive are contained. These areas of the tank 8 are separated by a baffle 13 which extends across the interior of the tank 8.

The removable bottom 9 is provided with a series of fins 14 (see FIG. 4) which protrude up into the main reservoir area. The fins 14 provide additional surface area for transfer of heat to the thermoplastic adhesive which is provided by cartridge type heating elements 15 contained in the bottom 9. The attachment of the bottom 9 which contains the heating elements 15 to the tank 8 is sealed by a gasket 16 made of an insulating, high temperature gasket material; this greatly reduces the transfer of heat from the removable bottom 9 to the main frame casting (tank 8) of the machine. The bottom 9 is also provided with a drain plug 17 which provides means for draining the tank 8 without removing the bottom 9. Since the plug 17 would most likely be hot when it is removed to drain the tank 8, it is preferable to provide a strap 18 made from spring steel to retain the plug 17 against the bottom 9 after removal.

Figure 4A:
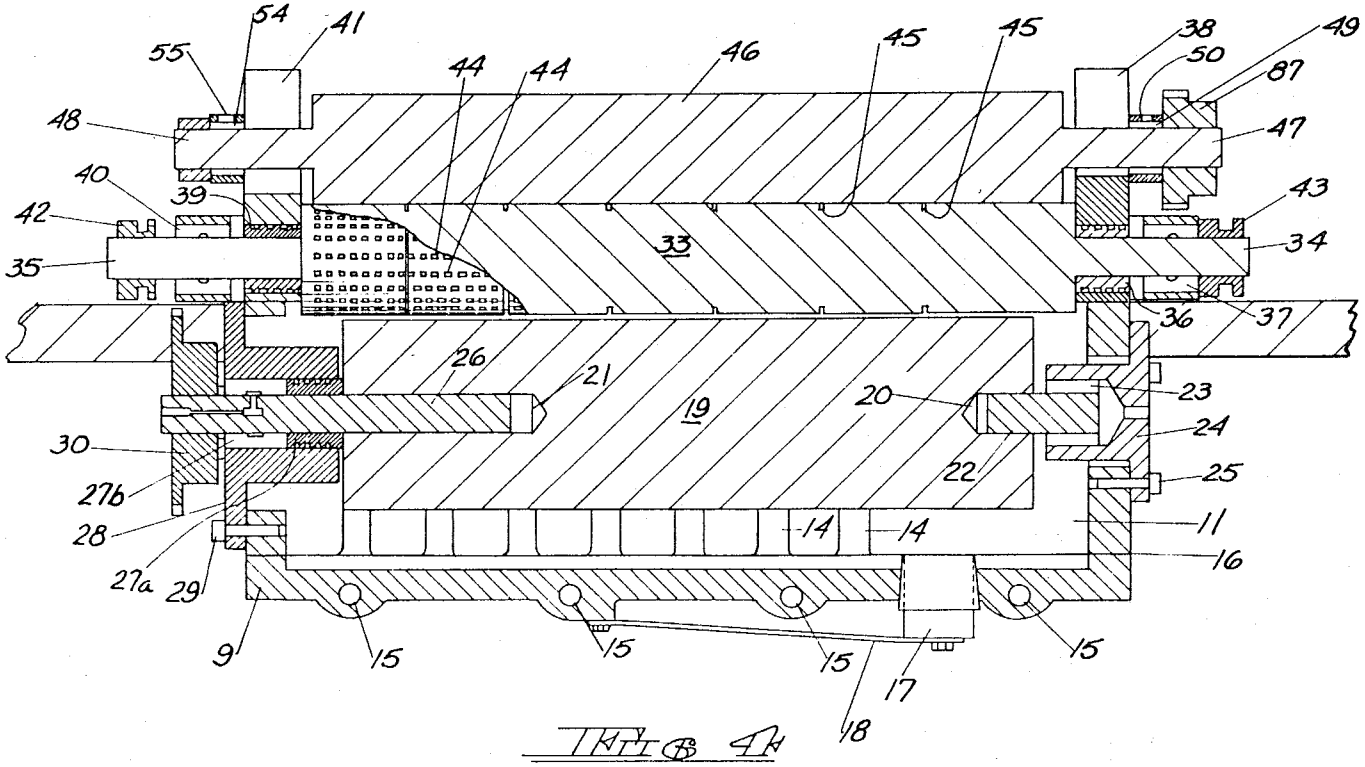
FIG. 4 is a cross sectional view taken along the line 4—4 in FIG. 3.
Figure 5:
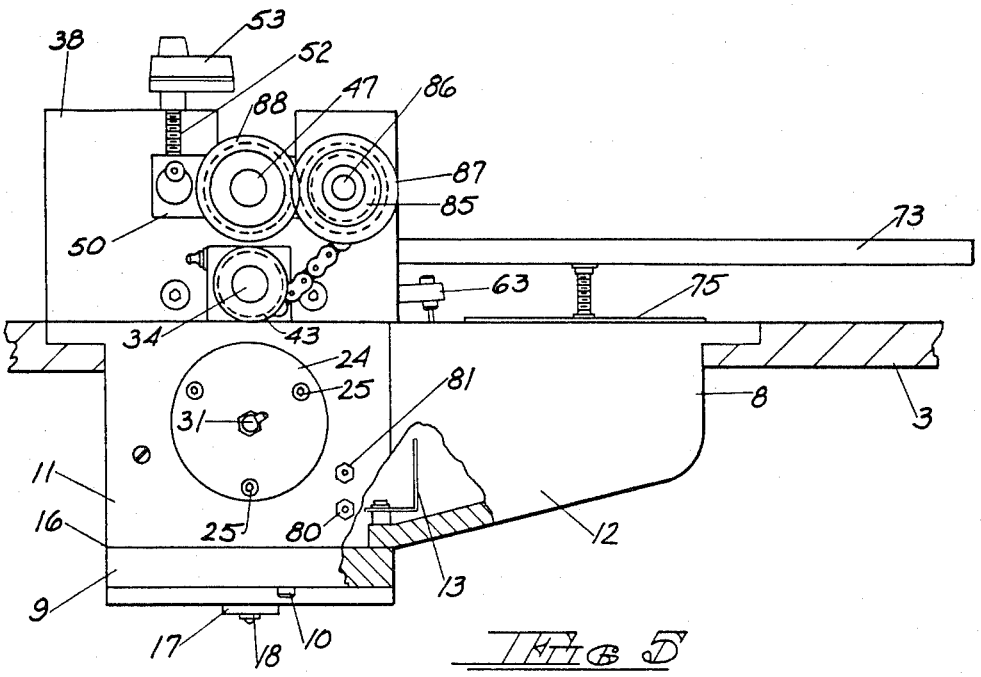
FIG. 5 is a fragmentary side elevational view as seen from the left in FIG. 3.
Figure 6:
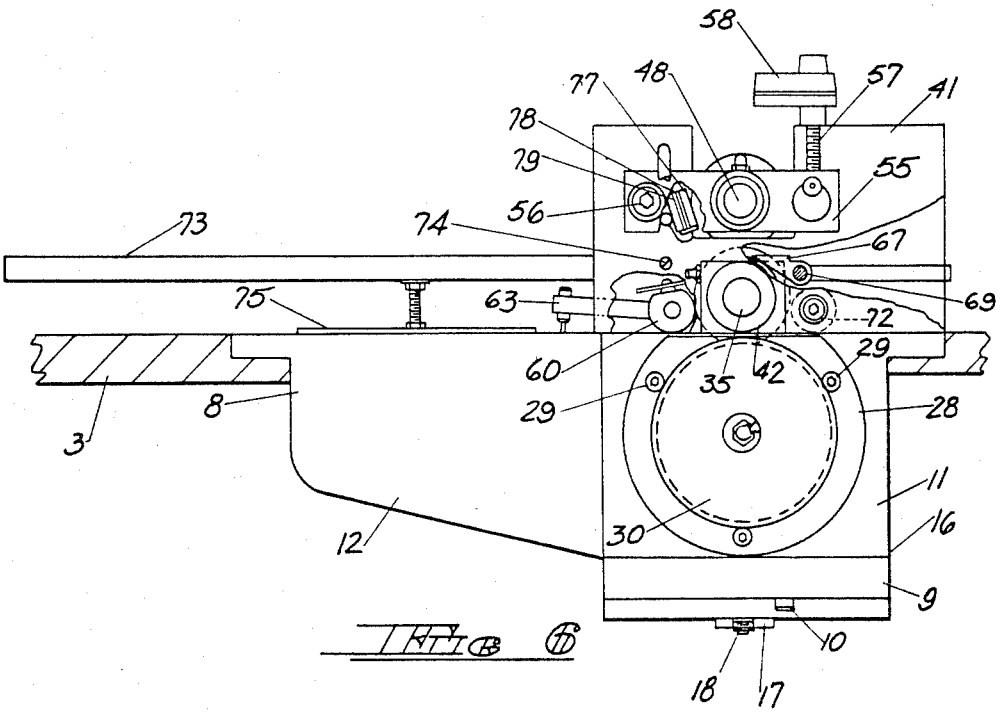
FIG. 6 is a fragmentary side elevational view as seen from the right in FIG. 3.

Mounted within the main reservoir area 11 is a mixing roll 19. As is also true for other rolls which will be described hereinafter, the mixing roll 19 is in the shape of an elongated cylinder, as is apparent by the sectional views of FIGS. 4 and 7. Referring specifically to FIG. 4, the mixing roll 19 has a bore 20 at its freely rotating end and a bore 21 at its driven end. Pressed into the bore 20 is a dowel pin 22 which is received by a bearing 23 and bearing housing 24, the housing 24 being attached to the side of the tank 8 by bolts 25. Pressed into the bore 21 of the driven end of the mixing roll 19 is a shaft 26 which passes through rotating seal 27*a* and is supported by a bearing 27*b* constrained by a housing 28, the housing 28 also being attached to the side of the tank 8 by conventional means such as bolts 29. Attached at the end of the shaft 26 and external to the tank 8 is a sprocket wheel 30 which is linked to the drive means 5, as will be more fully discussed hereinafter. Fittings 31 and 32 are provided to facilitate lubrication of the bearings 23 and 27 which provide the rotative support for the dowel pin 22 and shaft 26 respectively.

Mounted above and with its axis parallel to that of the mixing roll 19 is an applicator roll 33. As noted previously, the applicator roll 33 has the shape of an elongated cylinder; however, its shape differs from that of the mixing roll 19 in that it is preferably somewhat greater in length and smaller in diameter. As shown in FIG. 4, the applicator roll 33 is rotatably mounted a fixed distance above the mixing roll 19. Specifically, each end of the applicator roll 33 is turned to a smaller diameter to form concentric shafts 34 and 35. The shaft 34 passes through a seal 36 which rotates with the shaft 34. Rotative support for the shaft 34 is provided by a bearing 37 which is in turn supported by an end block 38. Similarly, shaft 35 passes through a seal 39 and is supported by a bearing 40 which is supported by an end block 41. Mounted on the ends of the applicator roll 33 are sprocket wheels 42 and 43; sprocket wheel 42 is associated with the drive means 5 and sprocket wheel 43 is used to drive other elements, as will be more fully described hereinafter.

An essential feature of the applicator roll 33 is the provision of a regular pattern of indentations 44 in the surface of the applicator roll 33. The indentations 44 can have a variety of shapes, but are preferably rectangular at the surface of the roll, with the sides narrowing uniformly to a vertex at the bottom of the indentation 44. Each indentation 44 serves to carry a discrete quantity of adhesive for transfer to an individual die-cut part. Preferably, the indentations 44 occupy approximately 25% of the surface area of the applicator roll 33 so that a similar percentage of the surface area of the part will be coated with adhesive. However, the percentage can be varied to suit a particular application. As used in the specification and claims, the phrase dot pattern should be interpreted broadly, referring to an arrangement of discrete deposits of adhesive, regardless of the peripheral shape of the deposits. In addition, the applicator roll 33 is provided with a series of narrow circumferential grooves 45 which cooperate with other elements, as will be more fully described hereinafter.

Mounted above and essentially parallel to the applicator roll 33 is a pressure roll 46. The pressure roll 46 is also an elongated cylinder and has portions turned down at each end to form concentric shafts 47 and 48, similar to that of the applicator roll 33. The surface of the pressure roll 46 is hardened and highly polished so as not to marr the parts which pass between the pressure roll 46 and applicator roll 33.

Although the axis of the pressure roll 46 remains parallel to the axis of the applicator roll 33, the spacing between these rolls is variable. Specifically, the shaft 47 of the pressure roll 46 rotates within a bearing 49 which is supported by a pivot arm 50. One end of the arm 50 is pivotally connected to idler shaft 86 in the end block 38 while the other end of the arm 50 connects to an adjusting screw 52. A manually actuated dial 53 is provided to engage the adjusting screw 52 and raise or lower the end of the pivot arm 50 which, in turn, moves the end of the pressure roll 46. In a like manner, the shaft 48 at the other end of the pressure roll 46 rotates within a bearing 54 which is supported by a pivot arm 55. The arm 55 connects pivotally to end block 41 at 56 and at its other end to an adjusting screw 57 associated with a manual dial 58.

Figure 7:
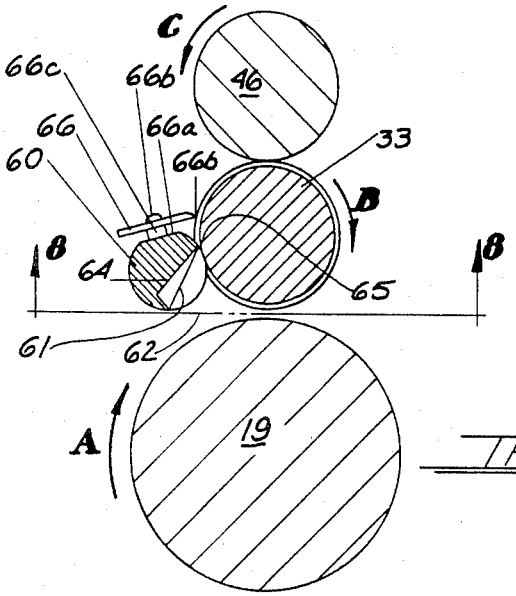
FIG. 7 is a schematic sectional view showing the relative positions of the various rolls and wipers incorporated in the apparatus of the present invention.

A critical feature of the present invention is the provision of a primary wiper 60 pivotally mounted between the end blocks 38 and 41 in a position relative to the applicator roll 33 as shown in FIG. 7. As will be more fully described hereinafter, the wiper 60 removes excess adhesive from the surface of the applicator roll 33 and from the grooves 45 in the applicator roll 33. It is referred to as primary since it initially limits the adhesive on the roll 33; it can be the only wiper, but is preferably used with an addition back-up wiper, as will be discussed hereinafter. The primary wiper 60 is an elongated cylindrical bar with a series of flats 61 milled in line along its length, creating a corresponding series of fins 62. The flats 61, where they intersect the peripheral surface of the wiper 60, provide a control edge 65 for the wiping action. The spacing of the fins 62 corresponds to the spacing of the grooves 45 such that each fin 62 completely fills a segment of the groove 45. A torque arm 63 is connected at the longitudinal center of the wiper 60 and is used to adjust or vary the relationship of the wiper 60 to the applicator roll 33. Preferably, a series of reliefs 64 (see FIGS. 7 and 8) are milled into the flats 61 to help control the hydraulic pressures built up by the adhesive between the applicator roll 33 and the primary wiper 60.

To control droplets of adhesive which tend to form on the top of the control edge 65 of the wiper bar 60 and transfer to the applicator roll 33, it is preferable to provide a secondary wiper 66 above the primary wiper 60. The secondary wiper 66 is an elongated flat rectangular plate located above the wiper 60, and attached directly to the wiper 60, as shown in FIG. 7. In this configuration the secondary wiper 66 can spread out any droplets of adhesive on the applicator roll 33, preventing subsequent transfer to the surface of the pressure roll 46. For attachment directly to the wiper 60, a flat surface 66*a* is preferably milled the length of the wiper 60. Screws 66*b* pass through the secondary wiper 66, spacers 66*c* and into the wiper 60. The openings in the secondary wiper 66 through which the screws 66*b* pass are elongated slots which provides means of adjustment of the secondary wiper 66 relative to the primary wiper 60. The secondary wiper 66 has a knife edge 66*d* to minimize the surface area which contacts the adhesive, preventing the accumulation of adhesive on the secondary wiper 66 in a manner similar to that of the primary wiper 60. In addition, the secondary wiper 66 preferably slopes downwardly away from the applicator roll 33 so that any adhesive which accumulates will not be later transferred to the applicator roll, but will run off.

To prevent parts from sticking to the applicator roll 33, the machine is provided with a series of stripping fingers 67 (see FIGS. 3 and 6) which ride in the grooves 45 of the applicator roll 33. The distance between the individual fingers 67 is controlled by spacers 68, the fingers 67 and spacer 68 being joined together by a tie rod 69. The ends of the tie rod 69 are supported by brackets 70 and 71 mounted on the end blocks 38 and 41 respectively. Preferably, a rod 72 is provided beneath the stripping fingers 67 between the end blocks 38 and 41 to rigidify the structure. In addition, the location of the rod 72 is controlled so that adhesive which may collect on the stripping fingers 39 will fall on the inward side of the rod 72 and drip down into the tank 8 below.

Preferably, the apparatus is provided with a pivoting feed table 73 connected between the end blocks 38 and 41 by conventional means such as set screws one of which is shown at 74. Connected to the underside of the feed table 73 is a cover 75 for the pre-melt area 12 of the tank 8. Thus, adhesive can be added by lifting the table 73 which raises the cover 75. Preferably, however, the table 73 is sufficiently isolated from the cover 75 so that there is minimal heat transfer between the cover 75 and the table 73.

It is also desirable to provide a felt wiper 77 (see FIGS. 3 and 6) along the length of the pressure roll 46. The felt wiper 77 is supported by a bracket 78 which is connected to the end blocks 38 and 41. The wiper 77 removes various contaminants, such as dirt, dust, fragments of the die-cut parts, etc. from the surface of the roll 46. A tape switch 79 can be provided on the rear of bracket 78 as a safety switch for shut down of the apparatus.

The process by which the elements discussed above function together to apply the adhesive to die-cut parts is set forth in detail in the following discussion. The pivoting table 73 is lifted, raising the cover 75 so that chunks of thermoplastic adhesive can be added to the pre-melt area 12 of the tank 8. The baffle 13 prevents the chunks of adhesive from entering the main reservoir area 11 of the tank 8. The temperature within the tank 8 is controlled by appropriate means such as a thermometer 80 and thermister 81 (see FIG. 5) located in the main reservoir area 11 of the tank 8.

Once the adhesive has melted and reaches the proper temperature for application, the drive means 5 is activated to power various elements of the apparatus. Specifically, the drive motor 6 is connected to a gear reducer 7 which has a double sprocket 82 (see FIG. 2) with a small diameter, inner portion 82*a* and a large diameter outer portion 82*b*. The inner portion 82*a* of the sprocket 82 is connected to the sprocket wheel 30 which drives the mixing roll 19; the outer portion 82*b* of the sprocket 82 is connected to the sprocket 42 on the applicator roll 33. Accordingly, the mixing roll 10 and applicator roll 33 are rotating in the same direction. Rotation is imparted to the pressure roll 46 by way of the applicator roll 33. To accomplish this, the sprocket 43 is connected to a sprocket 85 on an idler shaft 86 (see FIGS. 3 and 6). Behind the sprocket 85 on the shaft 86 is a gear 87 which engages a second gear 88 on the shaft 47 of the pressure roll 46. Since the idler shaft 86 is the pivot point of the arm 50 the distance between the gears 87 and 88 is fixed so that there is constant engagement regardless of the position of the pressure roll 46 with respect to the applicator roll 33. By the mechanism just described, the pressure roll 46 is given a rotation opposite that of the applicator roll 33 and mixing roll 19. As clearly indicated in FIG. 7, the mixing roll and applicator roll 33 rotate in the direction of arrows A and B respectively, while the pressure roll 46 rotates in the direction of arrow C.

Figure 8:
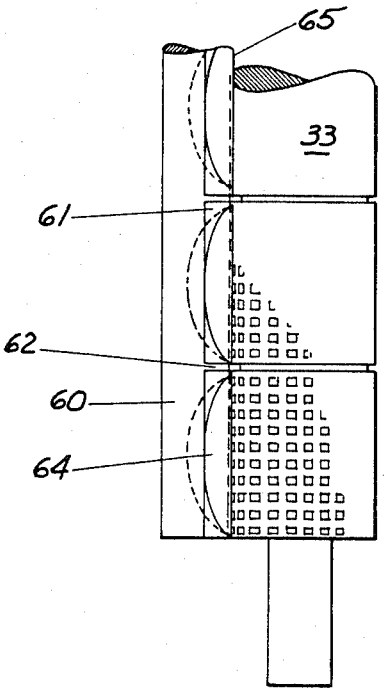
FIG. 8 is a bottom view of the applicator roll and primary wiper taken along the line 8—8 of FIG. 7.

The process of applying the adhesive begins as the mixing roll 19 is partially submerged and rotates within a pool of molten thermoplastic adhesive in the main reservoir area 11. The viscosity of the adhesive causes it to adhere to the surface of the mixing roll 19, and be carried up, contacting the applicator roll 33. The applicator roll 33 picks up a quantity adhesive from the surface of the mixing roll 19. The amount of adhesive which remains on the applicator roll 33 is controlled by the primary wiper 60. Specifically, the wiper 60 is disposed with respect to the applicator roll 33 as shown in FIGS. 7 and 8 and removes the excess adhesive from the outer surface of the applicator roll 33, leaving adhesive only in the indentations 44. The fins 62 of the primary wiper 60 also act to remove essentially all adhesive from the grooves 45 in they applicator roll 33.

The die-cut part to which the adhesive is to be applied is placed on the table 73 with the side to receive the adhesive against the surface of the table 73. The part is then slid on the table towards the applicator roll 33. The counter-rotation of the applicator roll 33 and pressure roll 46 causes the part to advance through the apparatus once contact is made with the rolls. As the part passes over the applicator roll 33 the adhesive in the indentations 44 adheres to the surface of the part and hardens almost immediately due to the relative coolness of the part. The adhesive thus transferred forms a pattern of dots of adhesive on the surface of the part. The stripping fingers 67 ride within the grooves 45 of the applicator roll 33 to overcome any tendency of the part to stick to the applicator roll 33, guiding the part away from and out of engagement with the rolls 33 and 46. A succession of parts can, in like manner, be passed through the machine and coated with adhesive.

As should now be apparent, the present invention provides an apparatus and process for applying thermoplastic adhesive in a dot pattern to die-cut parts. Certain variations, such as changing the relative position and sizes of the rolls, will be apparent to one skilled in the art and can be made without departing from the spirit and purpose of the present invention.

What we claim is:

1. An apparatus for applying thermoplastic adhesive to a die-cut part comprising:
   - a frame having an enlarged, closed cavity which serves as a reservoir for the adhesive;
   - heater means associated with the frame for melting the adhesive and maintaining the adhesive in a molten state;
   - a mixing roll rotatably attached to the frame and located, at least partially, within the cavity of the frame;
   - an applicator roll rotatably mounted above and parallel to the mixing roll such that the applicator roll can pick up adhesive from the surface of the mixing roll, the applicator roll having a pattern of indentations and a series of spaced, narrow circumferential grooves in its surface;
   - primary wiper means adjacent the applicator roll for removing excess adhesive from the outer surface and grooves of the applicator roll;
   - a pressure roll rotatably mounted above the applicator roll;
   - stripping means associated with the grooves in the applicator roll for guiding the part away from the applicator roll after the adhesive has been applied; and
   - drive means for rotating the mixing roll, applicator roll and pressure roll.

2. The apparatus claimed in claim 1 including secondary wiper means adjacent the applicator roll for spreading out drops of adhesive which accumulate on the primary wiper means and transfer to the surface of the applicator roll.

3. The apparatus claimed in claim 1 wherein the cavity of the frame has a bottom which is removable.

4. The apparatus claimed in claim 1 including means to adjust the distance between the pressure roll and the applicator roll.

5. The apparatus claimed in claim 1 wherein the primary wiper means comprises a rigid rod-like element rotatably attached to the frame, having spaced, flat surfaces along its length which intersects its peripheral surface to provide an edge for wiping the surface of the applicator roll and fins between the flat surfaces which engage and wipe the grooves in the applicator roll.

6. The apparatus claimed in claim 1 wherein the stripping means comprises a series of spaced, knife-like fingers which are supported by means associated with the frame and ride in the grooves of the applicator roll.

7. The apparatus claimed in claim 1 including baffle means in the cavity of the frame to divide the cavity into a pre-melt area and a main reservoir area.

8. The apparatus claimed in claim 1 including auxiliary wiper means adjacent the pressure roll for cleaning contaminants from the surface of the pressure roll.

9. The apparatus claimed in claim 1 including a feed table pivotally attached to the frame near the applicator roll and pressure roll.

10. The apparatus claimed in claim 2 wherein the secondary wiper means is attached to the primary wiper means.

11. The apparatus claimed in claim 3 wherein the heater means comprises cartridge heating elements located in the bottom of the cavity.

12. The apparatus claimed in claim 4 wherein the means to adjust the distance between the pressure roll and applicator roll comprises a pair of arms, each arm having an end pivotally connected to the frame and a free end, the pressure roll being connected between the free ends, and an adjustment screw associated with each arm.

13. The apparatus claimed in claim 5 including means to rotate the primary wiper means and adjust the relationship of the edge of the primary wiper means and the surface of the applicator roll.

14. The apparatus claimed in claim 5 including reliefs in the flat surfaces of the wiper means to reduce the pressure built up by the adhesive.

15. The apparatus claimed in claim 11 including a gasket made of insulating, high-temperature material to seal the connection of the removable bottom to the frame and minimize heat transfer therebetween.

* * * * *